United States Patent [19]

Brown

[11] 4,319,925

[45] Mar. 16, 1982

[54] COATING COMPOSITIONS FOR METAL CASTING MOLDS

[75] Inventor: William F. Brown, Colony, Tex.

[73] Assignee: Weston Research Corporation, Rothschild, Wis.

[21] Appl. No.: 241,008

[22] Filed: Mar. 6, 1981

[51] Int. Cl.[3] ..... B28B 7/36

[52] U.S. Cl. ..... 106/38.27; 106/38.22; 164/33; 427/134; 427/135; 501/105; 501/107; 501/129

[58] Field of Search ..... 106/38.22, 38.27, 57, 106/68, 69

[56] References Cited

U.S. PATENT DOCUMENTS 1,886,249 11/1932 Bensing .
2,544,598 3/1951 Kalina .
3,059,296 10/1962 North .
3,243,397 3/1966 Hermkimer et al. .
3,436,235 4/1969 Baer, Jr. et al. .
3,447,936 6/1969 Ornitz .
3,859,153 1/1975 Beyer et al. .

*Primary Examiner*—Lorenzo B. Hayes
*Attorney, Agent, or Firm*—Michael, Best & Friedrich

[57] ABSTRACT

A composition for coating the molding surfaces of molds for casting metal parts comprising an aqueous dispersion containing finely divided zirconia, a colloidal silica composition, finely divided mica, finely divided zircon, finely divided bentonite and, optionally, an inert coloring agent. While capable of protecting the molding surfaces against high temperature molten metal and producing castings having substantially defect-free surfaces, the coating composition provides cleaner castings by partially attaching to the casting and spalling off as the casting cools.

6 Claims, No Drawings

COATING COMPOSITIONS FOR METAL CASTING MOLDS

BACKGROUND OF THE INVENTION

This invention relates to coatings for molds used in casting metal parts and, more particularly, to a refractory mold coating for metal molds used in casting iron, steel and other alloys.

Refractory mold coatings have been used for various types of metal casting molds to enhance the smoothness and uniformity of the casting surface. The refractory coating typically is applied to the molding surfaces as a slurry, such as by spraying, dipping and drying, and allowed to dry to a hardened state prior to pouring molten metal into the mold.

Examples of prior refractory mold coatings are disclosed in U.S. Pat. Nos. 1,886,249 (Bensing), 2,544,598 (Kalina), 3,243,397 (Herkimer et al), 3,436,235 (Baer et al), and 3,447,936 (Ornitz). While generally satisfactory, these coatings tend to have one or more of the following shortcomings: do not adhere sufficiently to the mold surfaces to withstand the washing away action as the molten metal is being poured into the mold, adhere strongly to the casting and makes stripping difficult, poor resistance to burn through with a resulting erosion of the mold, require multiple applications, excessively long drying time, and solids in coating tend to settle within relatively short time periods during storage. Other refractory compositions for different mold applications are disclosed in U.S. Pat. Nos. 3,059,296 (North) and 3,859,153 (Beyer et al).

SUMMARY OF THE INVENTION

One of the principal objects of the invention is to provide a coating composition for the molding surfaces of metal casting molds which is capable of producing castings having smooth uniform surfaces and yet is easily removable from the casting after cooling.

Another of the principal objects of the invention is to provide such a mold coating composition which is highly resistant to burn through and has an extended shelf life.

A further of the principal objects of the invention is to provide such a mold coating composition which can be conveniently applied as a single coating with minimum voids and skips and is capable of drying to provide a hard, highly heat reflective coating within a relatively short drying time.

Other objects, aspects and advantages of the invention would become apparent to those skilled in the art upon reviewing the following detailed description and the claims.

The mold coating composition provided by the invention is an aqueous suspension containing (a) about 25 to about 55 weight % finely divided zirconia, (b) about 10 to about 25 weight % colloidal silica, (c) about 15 to about 35 weight % finely divided mica, (d) about 2 to about 20 weight % finely divided zircon, (e) about 0.5 to about 6 weight % finely divided bentonite, (f) 0 to about 3 weight % of an inert coloring agent, all based on the total weight of (a)-(f), and sufficient water to provide a Baume' density of about 50 to about 80°.

DESCRIPTION OF THE PREFERRED EMBODIMENT

The mold coating composition provided by the invention can be used on a variety of molds, including centrifugal and permanent steel and iron molds. It can also be used to protect mold chills and jaggers and, when natural sand is employed, it can be used as a bottom board and flask wash.

The mold coating composition is quick setting and provides a smooth, hard finish. After hardening, the resulting coating can withstand temperatures of 3,000°-3,500° F. and even higher, and is resistant to burn through and wash out during metal pouring. One particularly unique and advantageous characteristic of the coating composition is that it tends to become partially attached to the casting and, as the casting cools, spalls or flakes off the casting, leaving relatively clean castings from which the remaining coating material can be easily stripped.

While the theory by which the mold coating composition of the invention functions to provide the above and other advantageous properties is not fully understood, some observations have been made. Unless noted otherwise, the weight percentages disclosed below are based on the total weight of all the ingredients in the coating composition, except for the water added as the carrier for formation of a slurry.

Zirconia provides the coating with refractory properties and, because of its high melting point, permits the molten metal to be poured into the mold at higher temperatures which minimizes surface defects in the casting. The zirconia is in finely divided or comminuted form, preferably at least the majority of particles being −325 mesh. The amount of zirconia is about 25 to about 55, preferably about 30 to about 45 weight %.

To provide a smoother coating surface and high heat resistance and still minimize cost, a mixture of lower purity zirconia, such as Insuloxide (contains approximately 95% $ZrO_2$) marketed by NL Industries of Highstown, N.J., and a finer, higher purity zirconia, such as Electrically Fused Zirconia Oxide 441 (contains approximately 99% $ZrO_2$) marketed by TAM Ceramics of Niagra Falls, N.Y., is preferred. When such a mixture is used, the amount of the lower purity zirconia can be about 15 to about 30, preferably about 18 to about 24, weight % and the amount of the higher purity zirconia can be about 10 to about 25, preferably about 16 to about 20, weight %.

Finely divided zircon (zirconium silicate) particles, i.e., at least a majority being −325 mesh, usually are rounded and polished and, therefore, enhance the smoothness of the coating surface. Zircon also enhances the heat insulating properties and compressive strength of the coating. The amount of zircon used is about 2 to about 20, preferably about 5 to about 15, weight %.

Mica, while considerably less expensive than zirconia and zircon, enhances the heat insulative properties of the coating because of its low thermal conductivity and improves the reflectivity of radiant heat. The amount of mica used is about 15 to about 35, preferably about 20 to about 30, weight %.

The colloidal silica composition serves primarily as a binder for the refractory ingredients and promotes adherence of the coating to the mold surface prior to pouring. Various colloidal silica compositions conventionally used in investment casting and the like can be employed. Representative suitable commercially available colloidal silica compositions include the Ludox aquasols marketed by DuPont, particularly Ludox HS-40%, the Syton aquasols marketed by Monsanto Chemical and the Nalcoag aquasols marketed by Nalco Chemical. The amount of colloidal silica composition is about 10 to about 25, preferably about 15 to about 23 weight %. Amounts in excess of about 25 weight % tends to cause the coating to adhere too strongly to the molding surfaces and/or the casting with an attendant difficulty in cleaning the mold and casting.

Bentonite aids in maintaining the refractory ingredients suspended in the water carrier and promotes initial adherence of the coating to the molding surfaces. Excessive amounts of the bentonite can unduly reduce the compressive strength and heat resistance and also can reduce the tendency for the coating to partially attach to the casting. The amount of bentonite used is about 0.5 to about 6, preferably about 2 to about 4, weight %.

The inclusion of an inert coloring agent, such as W-4123 Phthalocyanine Blue (an aqueous suspension of phthalocyanine blue containing 34–37 weight % solids) marketed by Harshaw Chemical, permits the applicator to see voids and skips when the coating composition is being applied on the molding surfaces. When used, the amount of the coloring agent can be up to about 3 weight % and preferably is about 0.02 to about 2 weight %.

The color an be of a shade, such as light blue, which brightens the interior of the mold and makes it easier to detect foreign debris in the mold. Other suitable coloring agents can be used, such as W-3247 Burnt Umber (an aqueous dispersion of burnt umber containing 50–52 weight % solids) marketed by Harshaw Chemical.

The amount of water used in the coating composition depends on the particular coating technique employed. In any event, an amount of water sufficient to provide a density of about 50° to about 80° Baume', preferably about 65° to 75° Baume'. If the coating composition has the density below about 50° Baume', it is too fluid, causing running during application and the solid ingredients tend to settle too rapidly. On the other hand, if the coating composition has a denisty above about 80° Baume', it becomes so thick that it cannot be conveniently applied as a thin uniform coating.

The coating composition can be prepared by any suitable precedure whereby the ingredients are uniformly dispersed throughout. For example, all the liquid-containing ingredients, including the collodial silica composition, the coloring agent and water, can be added to a high speed blender and pre-mixed. The solid ingredients can be added to the pre-blended liquid ingredients in any sequence and the resultant mixture blended for a time sufficient to provide the desired dispersion.

The coating composition can be applied in any suitable manner, such as brushing or spraying, capable of providing a smooth coating of substantially uniform thickness over the molding surfaces. Generally, a coating thickness in the order of about 10 to 20 mils is sufficient to protect the molding surfaces and minimize surface defects in the casting.

Under ordinary atmospheric conditions, a coating of about 10 to 20 mils thick will dry in ambient air to a hardened condition suitable for pouring within a time period as short as one hour. However, in order to insure adequate hardening and minimize wash out during pouring, the coating should be allowed to dry in ambient air for at least 2 hours. Of course, the drying time can be reduced substantially by heating the mold and/or blowing heated air over the coating.

Without further elaboration it is believed that one skilled in the art can, using the preceeding description, utilize the present invention to its fullest extent. The following example is presented to exemplify a preferred embodiment of the invention and should not be construed as a limitation thereof.

EXAMPLE

A coating composition having the following composition has been found to yield excellent results when applied to the molding surfaces of a mold for casting iron parts:

| Ingredient | Weight, Lbs. | Weight % |
|---|---|---|
| Low purity zirconia(1) | 70 | 18.96 |
| High purity zirconia(2) | 60 | 16.25 |
| Colloidal silica(3) | 65 | 17.60 |
| Mica | 85 | 23.02 |
| Zircon | 35 | 9.48 |
| Bentonite | 8.75 | 2.37 |
| Coloring agent(4) | 0.5 | 0.14 |
| Water | 45 | 12.18 |
| | 369.25 | 100.00 |

Notes:
(1)Insuloxide (94.72% $ZrO_2$, 2.18 max. % retained on 325 mesh sieve) marketed by NL Industries.
(2)Electrically Fused Zirconium Oxide 441 (98.63% $ZrO_2$, 1.5% retained on 325 mesh sieve) marketed by TAM Ceramics.
(3)Ludox HS-40% (aqueous colloidal dispersion, 40 weight % silica as $SiO_2$) marketed by DuPont.
(4)W-4123 Phthalocyanine Blue (aqueous dispersion, 34–37 weight % solids) marketed by Harshaw Chemical.

The resulting suspension has a light blue color, has a Baume' density of 72°, does not freeze at temperatures about about 0° F., and has been found to remain stable after several months of on-shelf storage. A 10 mil thick coating of the composition dries to a hardened condition within approximately 1 hour under normal atmospheric conditions. The resulting coating is non-flammable and can withstand temperatures up to 3,000° F. without burn through. The coating partially attaches to the casting and spalls off the casting as the casting cools, leaving very little material which can be easily stripped off the casting.

From the foregoing description, one skilled in the art can easily ascertain the essential characteristics of the invention and, without departing from the spirit and scope thereof, can make various changes and modifications to adapt it to various usages and conditions.

I claim:

1. A coating composition for coating the molding surfaces of molds for casting metal parts comprising an aqueous suspension containing (a) about 25 to about 55 weight % finely divided zirconia, (b) about 10 to about 25 weight % colloidal silica, (c) about 15 to about 35 weight % mica, (d) about 2 to about 20 weight % finely divided zircon, (e) about 0.5 to about 6 weight % bentonite, (f) 0 to about 3 weight % of an inert coloring agent, all based on the total weight of (a)–(f), and sufficient water to provide a Baume' density of about 50° to about 80°.

2. A coating composition according to claim 1 containing sufficient water to provide a Baume' density of about 65° to about 75°.

3. A coating composition according to claim 1 containing about 30 to about 45 weight % of said zirconia, about 15 to about 23 weight % of said colloidal silica, about 20 to about 30 weight % of said mica, about 5 to about 15 weight percent of said zircon and about 2 to about 4 weight % of said bentonite.

4. A coating composition according to claim 3 containing about 0.02 to about 2 weight % of said coloring agent.

5. A coating composition according to claim 1 containing about 15 to about 30 weight % of a low purity zirconia and about 10 to about 25 weight % of a high purity zirconia.

6. A coating composition according to claim 5 containing about 18 to about 24 weight % of said low purity zirconia and about 16 to about 20 weight % of said high purity zirconia.

* * * * *